US011022400B2

(12) United States Patent
Pala

(10) Patent No.: US 11,022,400 B2
(45) Date of Patent: Jun. 1, 2021

(54) AMBIDEXTROUS SURVIVAL SELF-DEFENSE TOOL

(71) Applicant: Franck Pala, Miami, FL (US)

(72) Inventor: Franck Pala, Miami, FL (US)

( * ) Notice: Subject to any disclaimer, the term of this patent is extended or adjusted under 35 U.S.C. 154(b) by 0 days.

(21) Appl. No.: 16/554,788

(22) Filed: Aug. 29, 2019

(65) Prior Publication Data

US 2020/0200504 A1 Jun. 25, 2020

Related U.S. Application Data

(60) Provisional application No. 62/782,443, filed on Dec. 20, 2018.

(51) Int. Cl.
*F41B 15/02* (2006.01)

(52) U.S. Cl.
CPC ..... *F41B 15/02* (2013.01)

(58) Field of Classification Search
CPC ..... F41B 15/02
See application file for complete search history.

(56) References Cited

U.S. PATENT DOCUMENTS 4,842,277 A * 6/1989 LaCroix ..... F41B 15/04 361/232
5,192,075 A * 3/1993 Ashihara ..... F41B 15/025 463/47.4
5,295,687 A 3/1994 Bedard
5,363,285 A * 11/1994 Wideman ..... F21V 33/0064 362/102
6,791,816 B2 9/2004 Stethem
7,029,397 B1 4/2006 Barwick
8,231,474 B2 * 7/2012 Stethem ..... F41H 13/0087 463/47.3
2005/0083679 A1 * 4/2005 Macierowski ..... F41B 15/027 362/102
2014/0256453 A1 * 9/2014 Pelkey ..... F41B 15/027 463/47.7
2016/0010847 A1 * 1/2016 Bellows ..... F41B 15/06 362/96
2016/0069650 A1 * 3/2016 Flynn ..... F41H 9/10 463/47.4

* cited by examiner

*Primary Examiner* — David L Lewis
*Assistant Examiner* — Shauna-Kay Hall
(74) *Attorney, Agent, or Firm* — Boudwin Intellectual Property; Daniel Boudwin

(57) ABSTRACT

An ambidextrous survival self-defense tool having a first bar and a second bar. The first bar is designed with a plurality of ribs next to each other at least partially along the surface. One end of the first bar tappers to a point. The point is a blunt point, the point in blunt due to roundness of the point. A second end of the first bar has a first striker attached. The striker is a round ball. The second bar is attached to the first bar perpendicularly along the body of the first bar. The second bar has a striker at one end. The striker is a round ball. A glass breaking point is added to an end of the first bar. A belt cutter is imbedded into the first bar along the body.

20 Claims, 5 Drawing Sheets

AMBIDEXTROUS SURVIVAL SELF-DEFENSE TOOL

CROSS REFERENCE TO RELATED APPLICATIONS

This application claims the benefit of U.S. Provisional Application No. 62/782,443 filed on Dec. 20, 2018. The above identified patent application is herein incorporated by reference in its entirety to provide continuity of disclosure.

BACKGROUND OF THE INVENTION

The present invention relates to an ambidextrous survival self-defense tool. More particularly, the present invention provides an ambidextrous survival self-defense tool to be used when acting in self-defense that is easy to use.

Many people are unfortunately placed in a situation today where they need to defend themselves against attackers. When in these situations a person may wish to have something to defend themselves with. In this situation there are many different options however, each of these options may present complications. For example, using a gun or a knife could result in legal trouble for the individual that felt the need to defend themselves. Many states do not allow various forms of protection because they are deemed dangerous and can cause severe injury.

Consequently, there is a need in for an improvement in the art of self-defense devices. The present invention substantially diverges in design elements from the known art while at the same time solves a problem many people face in protecting themselves. In this regard the present invention substantially fulfills these needs.

SUMMARY OF THE INVENTION

The present invention provides an ambidextrous survival self-defense tool wherein the same can be utilized for providing convenience for the user when acting in self-defense. The ambidextrous survival self-defense tool comprises a first bar and a second bar. The first bar has a plurality of ribs. A second end of the first bar comes to a blunt point that is narrower than the rest of the bar, the point may be rounded. The second bar is perpendicularly attached to the first bar. A striker ball is attached to the first bar on the end opposite the blunt point. A second striker ball is attached to the second bar on the end opposite the connection to the first bar. Another object of the invention Other objects, features and advantages of the present invention will become apparent from the following detailed description taken in conjunction with the accompanying drawings.

Another aspect of the survival self-defense tool is a very powerful versatile and efficient tool allowing by is weight and versatility the defender to use it even with any basic online training. As far as is perfect ergonomic fit, it will not fall from open hands up in self-defense position. Also, it is very hard to take the ambidextrous self-defense too from one's hands if you squire it hard. A very important aspect of the survival self-defense tool is, it is a non-intimidating tool, and there is no need for a concealed carry permit. It is important that the ambidextrous self-defense tool is a non—lethal device. This ensures that the tool is not classified as a weapon.

Another object of the present invention is an ambidextrous survival self-defense tool, comprising, a first bar and a second bar, wherein the first bar is ribbed. The first bar has a first and a second end. The second end of the first bar defines a point, wherein the point has a glass breaker located thereon. The second bar having a first end and a second end. The second bar is perpendicularly attached to the first bar at the first end of the second bar between the first end and second end of the first bar.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
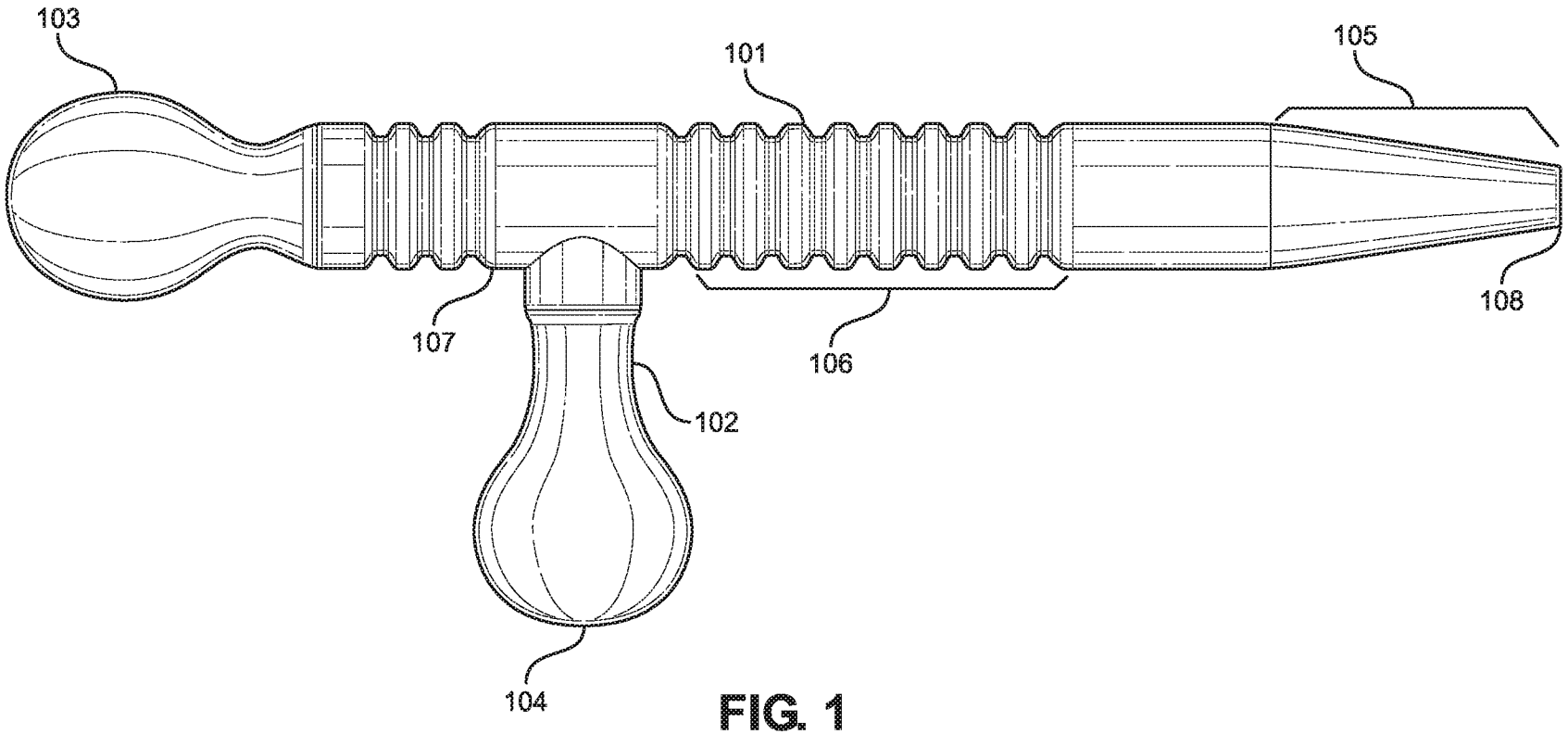
FIG. 1 shows a top down view of an embodiment of the ambidextrous survival self-defense tool.

Reference is made herein to the attached drawings. Like reference numerals are used throughout the drawings to depict like or similar elements of the ambidextrous survival self-defense tool. For the purposes of presenting a brief and clear description of the present invention, a preferred embodiment will be discussed as used for the ambidextrous survival self-defense tool. The figures are intended for representative purposes only and should not be considered to be limiting in any respect.

Referring now to FIG. 1, there is shown a top down view of an embodiment of the ambidextrous survival self-defense tool. The ambidextrous survival self-defense tool is made up of a first bar 101 and a second bar 102. The first bar 101 has a length greater than that of the second bar 102. The first bar 101 has a plurality of ribs 106 covering at least part of the length of the bar. The ribs 106 are configured to make the ambidextrous survival self-defense tool easier to grip. In this manner, the ribs 106 may allow a user to have a better grasp of the ambidextrous survival self-defense tool, which can prevent the ambidextrous survival self-defense tool from slipping during use.

The second end of the first bar 101 narrows toward the end. This narrowing can happen gradually over a length 105 of the bar. The narrowing forms a blunt pointed tip 108. This blunt tip may be rounded to ensure it will not puncture skin. On a first end of the first bar 101 there may be a striker 103. The striker 103 may have a width that is greater than that of the first bar 101. The striker 103 may be a rounded ball that attached to the first end of the first bar 101.

The second bar 102 may be perpendicularly attached to the first bar 101 between the first and second ends of the first bar 101 at an attachment point 107. The second bar 102 may have a width that will allow it to be placed between fingers. On a second end of the second bar 102 there may be a striker 104. The striker 104 may have a width that is greater than that of the second bar 102. The striker 104 may be a rounded ball that attached to the end of the second bar 102.

The device may be made up of various materials. In one embodiment he device is made of wood. In another embodiment the device may be made of a heavy plastic. In third embodiment the device can be metal. In one embodiment the ambidextrous self-defense tool is made from 140 grams of a high-grade metal. The device may have a protective coating placed thereon. The coating may be a rubber covering. In second embodiment the coating can be a paint mixture.

Figure 2:
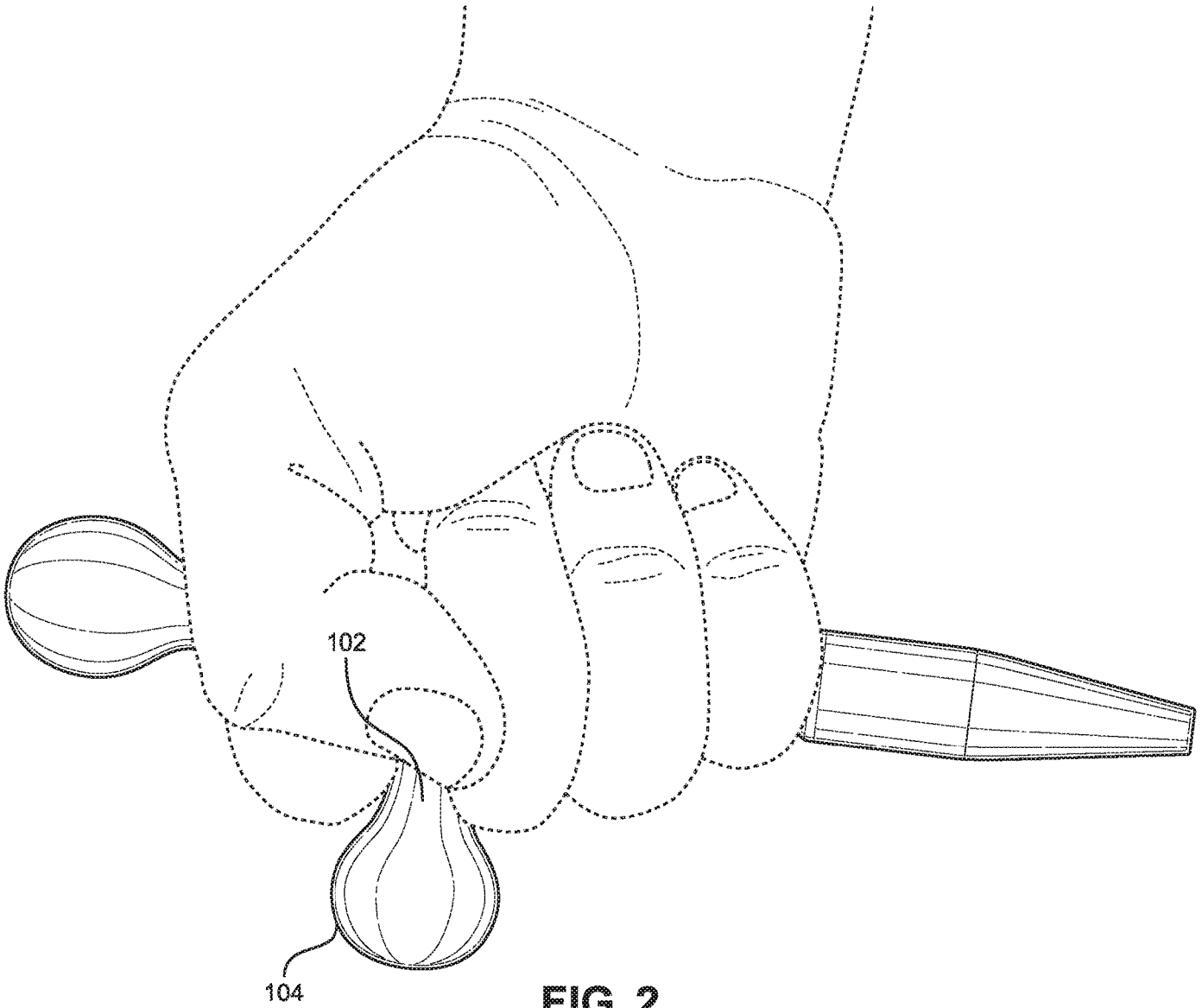
FIG. 2 shows an in-use view of an embodiment of the ambidextrous survival self-defense tool with the second bar disposed between an index and middle finger.
Figure 3:
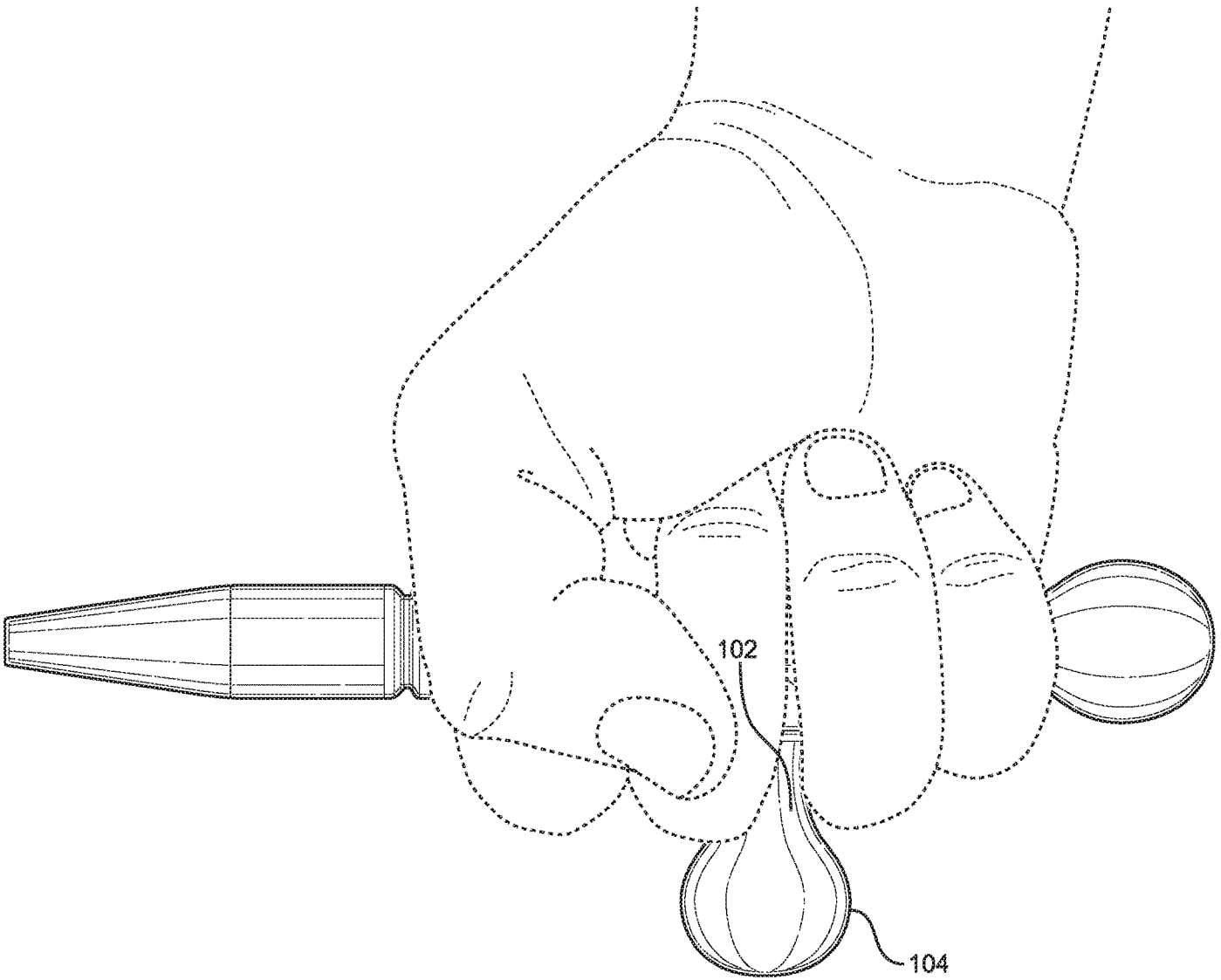
FIG. 3 shows an in-use view of an embodiment of the ambidextrous survival self-defense tool with the second bar disposed between a middle finger and a ring finger.
Figure 4:
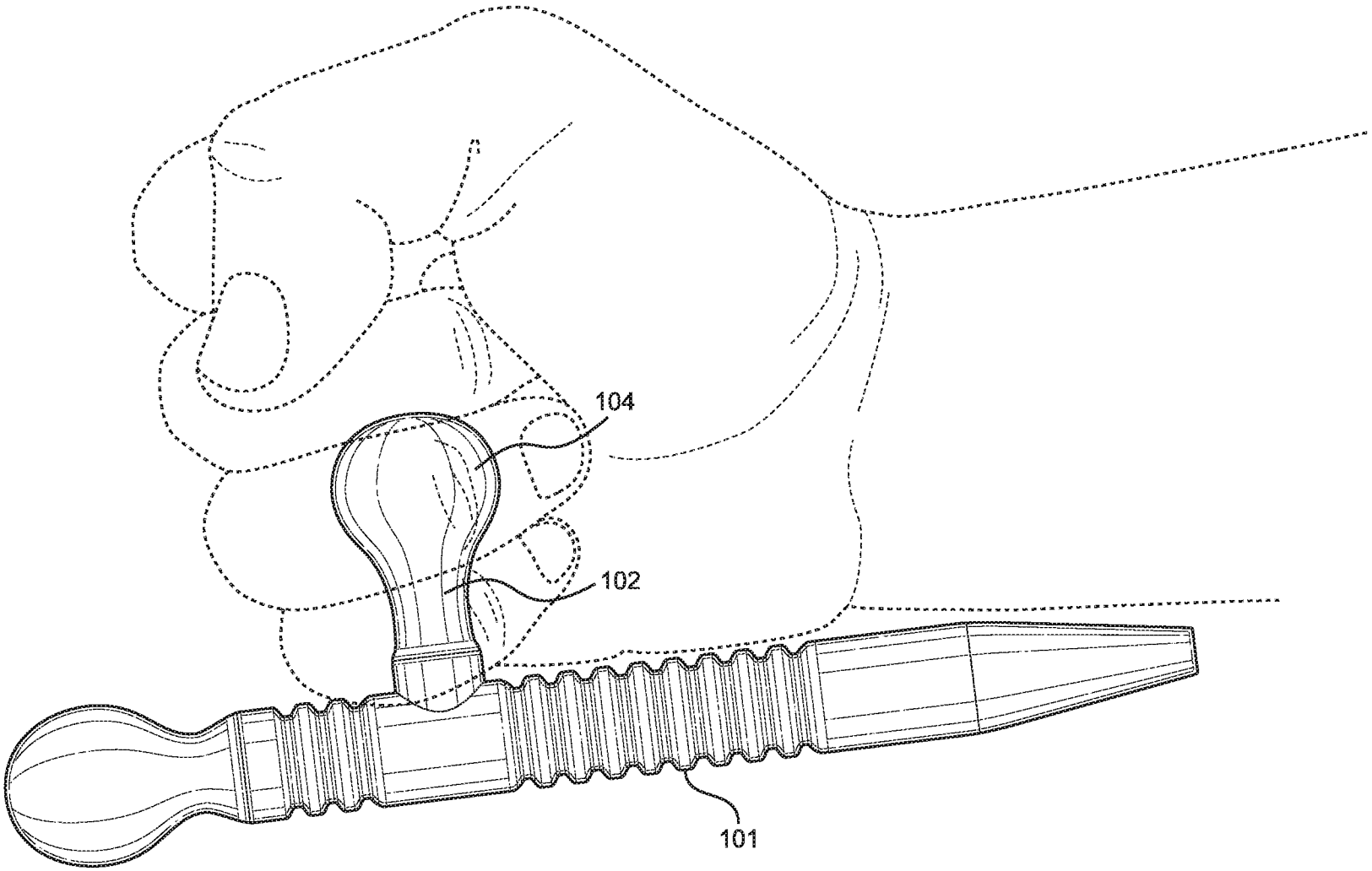
FIG. 4 shows an in-use view of an embodiment of the ambidextrous survival self-defense tool with the second striker held by the user.

Referring to FIGS. 2-4 there is shown various in use images of an embodiment of the ambidextrous survival self-defense tool. The unit may be proportioned to fit in a user's hand. In one embodiment the device may be held such that the second bar 102 is placed between a user's index finger and middle finger. In this embodiment the second striker 104 will protrude above the fingers. In another embodiment the device may be used by placing the second bar 102 between a user's middle finger and ring finger. Similarly, in this embodiment the second striker 104 will protrude above the fingers. In yet another embodiment a user may grasp the second striker 104 and the second bar 102. In this embodiment the second striker 104 will be covered by the hand and the first bar 101 will run along the user's wrist.

Figure 5:
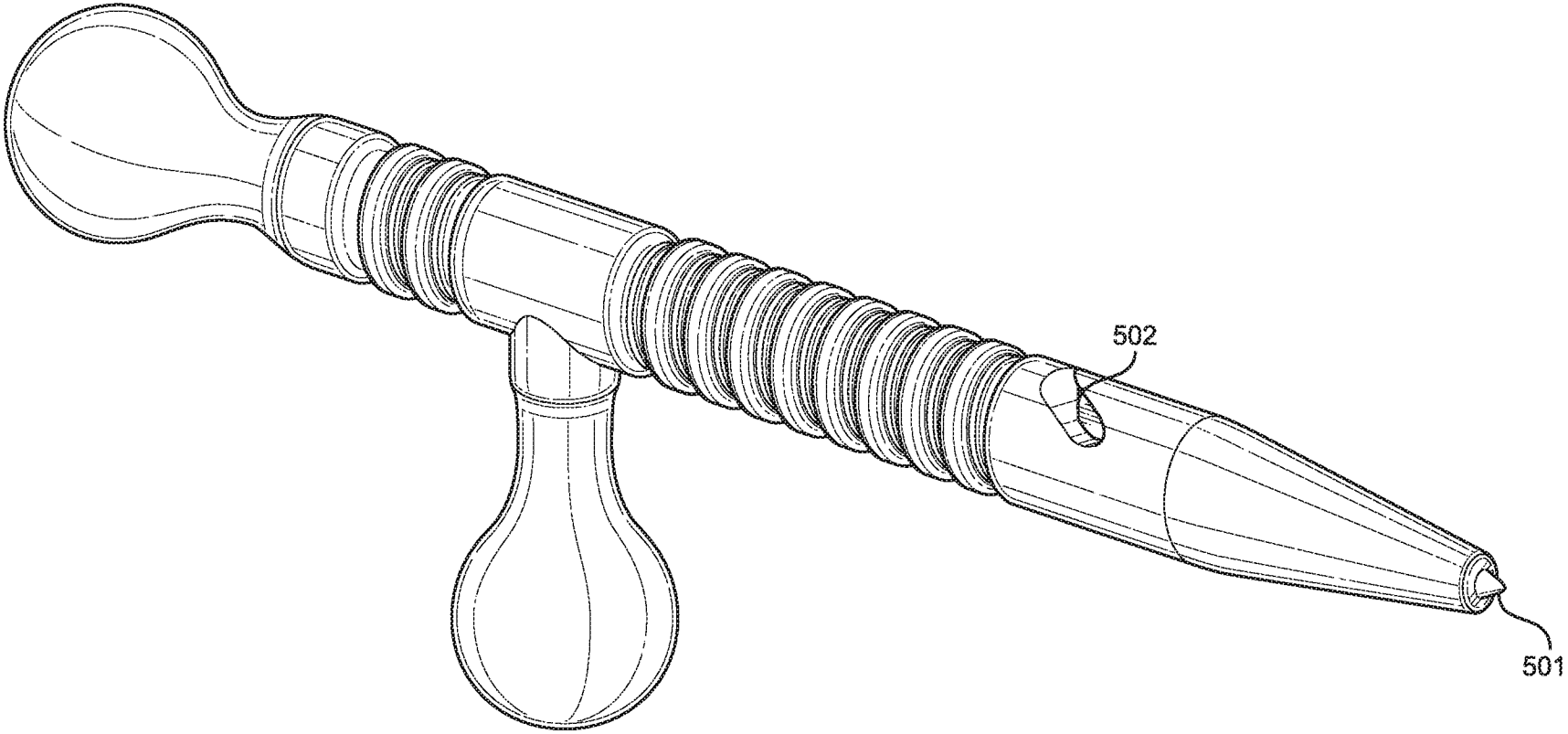
FIG. 5 shows a perspective view of an embodiment of the ambidextrous survival self-defense tool with a belt cutter and a glass breaker.

Referring now to FIG. 5, there is shown a perspective view of an embodiment of the ambidextrous survival self-defense tool with a belt cutter and a glass breaker. The blunt tip of the ambidextrous survival self-defense tool may have a glass breaker 501 attached. The glass breaker 501 is a pointed tip made from a sufficiently hard material that will allow safety glass to be broken on contact. The glass breaker 501 should be relatively short such that it will not puncture skin.

In this embodiment there is also a belt cutter 502. The belt cutter 502 is configured to be placed along the device. The belt cutter 502 is sharp enough to cut through a seat belt of a motor vehicle. This will allow the ambidextrous survival self-defense tool to also function as an emergency tool.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An ambidextrous survival self-defense tool, comprising:

a first bar having a first end and a second end;

the second end of the first bar defines a blunt end;

a second bar having a first end and a second end;

the second bar is perpendicularly attached to the first bar at the first end of the second bar between the first end and the second end of the first bar;

a plurality of ribs disposed along the first bar in a pair of distinct sections;

wherein a first section of the plurality of ribs is disposed between the first end of the first bar and the second bar, and a second section of the plurality of ribs is disposed between the second end of the first bar and the second bar.

2. The ambidextrous survival self-defense tool of claim 1, further comprising a striker attached to the first end of the first bar, wherein the striker has a width greater than that of the first bar.

3. The ambidextrous survival self-defense tool of claim 2, wherein the striker is a ball.

4. The ambidextrous survival self-defense tool of claim 1, further comprising a striker attached to the second end of the second bar, wherein the striker has a width greater than that of the second bar.

5. The ambidextrous survival self-defense tool of claim 4, wherein the striker is a ball.

6. The ambidextrous survival self-defense tool of claim 1, wherein the first bar and the second bar are composed of metal.

7. The ambidextrous survival self-defense tool of claim 1, wherein the first bar and the second bar are composed of plastic.

8. The ambidextrous survival self-defense tool of claim 1, wherein the first bar and the second bar have an exterior protective coating.

9. The ambidextrous survival self-defense tool of claim 1, wherein the second end tapers toward the blunt end.

10. The ambidextrous survival self-defense tool of claim 1, further comprising a belt cutter statically disposed within the first bar.

11. The ambidextrous survival self-defense tool of claim 10, wherein the belt cutter is disposed within an angled notch within the first bar, wherein a distal end of the angled notch is nearer to the first end of the first bar than an opening of the angled notch.

12. The ambidextrous survival self-defense tool of claim 11, wherein a cutting edge of the belt cutter is oriented towards an opening of the angled notch.

13. The ambidextrous survival self-defense tool of claim 1, wherein the blunt end defines a planar surface.

14. The ambidextrous survival self-defense tool of claim 1, wherein the plurality of ribs comprise a plurality of concentric rings disposed at regular intervals along the first bar.

15. An ambidextrous survival self-defense tool, comprising:

a first bar having a first end and a second end;

the second end of the first bar defines a point, wherein the point has a glass breaker located thereon;

a second bar having a first end and a second end;

the second bar is perpendicularly attached to the first bar at the first end of the second bar between the first end and the second end of the first bar;

a plurality of ribs disposed alone the first bar in a pair of distinct sections;

wherein a first section of the plurality of ribs is disposed between the first end of the first bar and the second bar, and a second section of the plurality of ribs is disposed between the second end of the first bar and the second bar.

16. The ambidextrous survival self-defense tool of claim 15, further comprising a belt cutter statically disposed within the first bar.

17. The ambidextrous survival self-defense tool of claim 15, further comprising a striker attached to the first end of the first bar, wherein the striker has a width greater than that of the first bar.

18. The ambidextrous survival self-defense tool of claim 15, further comprising a striker attached to the second end of the second bar, wherein the striker has a width greater than that of the second bar.

19. The ambidextrous survival self-defense tool of claim 18, wherein the striker is a ball.

20. An ambidextrous survival self-defense tool, consisting of:

a first bar having a first end and a second end;

the second end of the first bar defines a point, wherein the point has a glass breaker located thereon;

a second bar having a first end and a second end;

the second bar is perpendicularly attached to the first bar at the first end of the second bar between the first end and the second end of the first bar; and a belt cutter statically disposed within the first bar, such that a cutting edge of the belt cutter is permanently disposed within the first bar.

* * * * *